US008418509B2

(12) United States Patent
Yoo et al.

(10) Patent No.: US 8,418,509 B2
(45) **Date of Patent: *Apr. 16, 2013**

(54) LAUNDRY TREATING MACHINE

(75) Inventors: Hea Kyung Yoo, Seoul (KR); Dae Yun Park, Seoul (KR); Jong Seok Kim, Seoul (KR); Dong Won Kim, Seoul (KR); Sog Kie Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 924 days.

This patent is subject to a terminal disclaimer.

(21) Appl. No.: 12/385,065

(22) Filed: Mar. 30, 2009

(65) Prior Publication Data

US 2009/0241606 A1 Oct. 1, 2009

(30) Foreign Application Priority Data

Apr. 1, 2008 (KR) ..... 10-2008-0030388

(51) Int. Cl.
*B08B 3/12* (2006.01)
*D06F 37/00* (2006.01)

(52) U.S. Cl.
USPC ..... 68/3 R; 68/5 C

(58) Field of Classification Search ..... 68/3 R
See application file for complete search history.

(56) References Cited

U.S. PATENT DOCUMENTS

| | | | |
|---|---|---|---|
| 2005/0034489 A1 | 2/2005 | Oh et al. | |
| 2005/0115120 A1 | 6/2005 | Cevik | |
| 2007/0131257 A1* | 6/2007 | Lee et al. | 134/56 D |

FOREIGN PATENT DOCUMENTS

| | | |
|---|---|---|
| DE | 44 32 489 | 3/1996 |
| DE | 102 60 151 | 7/2004 |
| EP | 1 441 059 | 7/2004 |
| EP | 1548177 A1 | 6/2005 |
| EP | 1 734 170 | 12/2006 |
| EP | 1 813 709 | 8/2007 |
| EP | 1900865 | 3/2008 |
| EP | 1900868 A1 | 3/2008 |
| EP | 1 936 023 | 6/2008 |
| WO | WO 03/074778 | 9/2003 |
| WO | WO 2006/091057 | 8/2006 |
| WO | WO 2006/100335 | 9/2006 |
| WO | WO 2007/145451 | 12/2007 |
| WO | WO 2008/010670 | 1/2008 |
| WO | WO 2008004802 A2 * | 1/2008 |
| WO | WO 2008/030053 | 3/2008 |

OTHER PUBLICATIONS

Aizpuru et al., Sep. 2006, WO 2006/100335, English machine translation of the description.*

* cited by examiner

*Primary Examiner* — Michael Barr
*Assistant Examiner* — Jason Ko
(74) *Attorney, Agent, or Firm* — McKenna Long & Aldridge LLP

(57) ABSTRACT

A laundry treating machine is disclosed. The present invention relates to a laundry treating machine capable of minimizing the number of parts required to discharge the generated condensate as possible and of simplifying the drainage path. A laundry treating machine includes a cabinet in which an accomodating space receiving laundry therein is formed, a moisture supply device supplying moisture to the accomodating space, a water supply part connected with the moisture supply device to supply water, a water discharge part discharging water condensed from the moisture supplied by the moisture supply device or water remaining in the moisture supply device, a circulation duct to draw-in air of the accomodating space and discharging the air into the accomodating space, and a heat exchanging part provided in the circulation duct, the heat exchanger in which circulated air is dehumidified or heated.

21 Claims, 3 Drawing Sheets

LAUNDRY TREATING MACHINE

CROSS REFERENCE TO RELATED APPLICATION

This application claims the benefit of Korean Patent Application No. 10-2008-0030388, filed on Apr. 1, 2008, which is hereby incorporated by reference as if fully set forth herein.

BACKGROUND OF THE DISCLOSURE

1. Field of the Disclosure

The present invention relates to a laundry treating machine. More particularly, the present invention relates to a laundry treating machine capable of supplying moisture to laundry and supplying hot air to the laundry having received the moisture in order to dry the laundry, such that unpleasant odor, wrinkles, or humidity remaining on the laundry may be removed.

2. Discussion of the Related Art

Laundry treating machines are electric appliances that treat clothes, cloth items and the like (hereinafter laundry) received in an accomodating space provided in a cabinet. Here, the term 'laundry received in the accomodating space' means a series of processes of supplying moisture and air or hot air to the laundry received in the accomodating space to remove unpleasant odor, wrinkles and humidity remaining on the laundry and to give satisfaction to a user who will wear the treated laundry.

For example, if the user puts on the same clothes more than once, unpleasant odors, wrinkles, or humidity may happen to remain on the clothes. The unpleasant odor of the clothes must give an unpleasant feeling to the user, who will put on the clothes again. To remove the unpleasant odors, wrinkles, or humidity, the clothes might be washed after every use. However, the repetitive washing of the clothes could shorten the wearable life of the clothes and could increase the maintenance cost.

There might be wrinkles even on the clothes, which have been dried after being washed. These wrinkled clothes cannot be worn immediately, and the user is inconvenienced by having to iron the clothes to remove the wrinkles.

To solve the above problems there is needed a laundry treating machine capable of removing the unpleasant odor, wrinkles, or humidity.

In such a laundry treating machine, moisture may be supplied and air, including hot air, may be circulated among the clothes to dry the moisturized laundry, and to remove the unpleasant odor, wrinkles, and humidity.

The unpleasant odor, wrinkles and humidity may be removed only by exposing the laundry to wind or hot air. At this time, the moisture may be supplied to the laundry to substantially maximize the removal effect.

If the moisture is supplied to the laundry received in the laundry treating machine, minute water elements are combined with odor elements remaining deep in fibrous tissues of the fabric and the water elements combined with the odor elements are separated and discharged from the laundry during the drying. By such a process, the unpleasant odor may be removed from the laundry.

Through the above processes, the unpleasant odor, the wrinkles, and humidity may be removed from the clothes and thus the user can put on the clothes, feeling pleasant and fresh.

Such a laundry treating machine, which is able to supply the moisture to laundry received in its accomodating space 12, should have a structure capable of receiving water. Also, the laundry treating machine must preferably drain condensed or contaminated water, which may be generated during the process of drying the laundry.

The amount of water supplied to the laundry, condensed from the supplied moisture, and contaminated during the treating period in the laundry treating machine may not be substantially much, compared with a washing machine.

The place where the supplied moisture condenses may be a place other than inside the accomodating space, where air is dehumidified. For example, in case that the supplied moisture is steam, the steam that is supposed to reach the received laundry might condense in various places on the steam supply path.

If condensed water remains in the accomodating space or if it otherwise collects in the cabinet, drying efficiency and user satisfaction may not be obtained.

Because of that, it is necessary to develop a method of efficiently supplying water required to generate the moisture and to discover a method of draining the water that condensed or remains in the cabinet during the moisture supply process and the drying process. Especially, it is required to provide a laundry treating machine capable of minimizing the number of parts required to discharge the generated condensate as possible and of simplifying the drainage path.

SUMMARY OF THE DISCLOSURE

Accordingly, the present invention is directed to a laundry treating machine.

Additional advantages and features of the disclosure will be set forth in part in the description which follows and in part will become apparent to those having ordinary skill in the art upon examination of the following or may be learned from practice of the invention. The advantages and features of the invention may be realized and attained by the structure particularly pointed out in the written description and claims hereof as well as the appended drawings.

To achieve these advantages and features, and in accordance with the purpose of the invention, as embodied and broadly described herein, a laundry treating machine includes a cabinet in which an accomodating space to receive laundry therein is formed; a moisture supply device configured to supply moisture to the accomodating space; a water supply part connected with the moisture supply device to supply water; a water discharge part discharging water condensed from the moisture supplied by the moisture supply device or water remaining in the moisture supply device; a circulation duct configured to draw-in air from the accomodating space and discharge the air back into the accomodating space; and a heat exchanging part provided in the circulation duct, the heat exchanger in which circulated air is dehumidified or heated.

The moisture supply device may be a water spraying device or a steam generator.

At least one of the water supply part and the water discharge part may be a detachable water tank.

The circulation duct and the moisture supply device may be provided in a mechanism compartment provided in the cabinet and the mechanism compartment is partitioned from the accomodating space. An inlet and an outlet may be formed at a bottom of the accomodating space, which partitions off inner space of the cabinet into the accomodating space and the mechanism compartment, the inlet sucking air inside the accomodating space into the circulation duct and the outlet discharging the air inside the circulation duct into the accomodating space.

The laundry treating machine may further include a water collecting tank collecting water condensed from the moisture supplied by the moisture supply device or water remaining in the moisture supply device and transferring the collected water to the water discharge part, if the water discharge is the detachable water tank.

The circulation duct may be connected with the water collecting tank and water condensed inside the circulation duct is collected in the water collecting tank.

The moisture supply device may be a steam generator and a steam spraying unit is provided in the accomodating space to supply steam generated in the steam generator, and water condensed and remaining in the steam generator is collected in the water collecting tank.

The water condensed in the steam spraying unit may be collected in the water collecting tank, passing the circulation duct connected with the steam spraying unit.

A cutoff valve selectively cutting off flow of condensed water may be provided at a pipe connecting the steam spraying unit with the circulation duct.

The water condensed in the accomodating space may be collected in the water collecting tank, passing the circulation duct.

The laundry treating machine may further include a drain pump pumping the water collected in the water collecting tank to the water discharge part configured of the water tank.

The water collecting tank may include a water level sensor measuring a water level of the collected water.

If the moisture supply device is a steam generator, a valve selectively cutting off the flow of water may be provided in at least one of a pipe connecting the water supply part and the steam generator and a pipe connecting the steam generator and the water collecting tank.

The steam spraying unit may be provided at a bottom of the accomodating space in plural.

The heat exchanging part may be a heat exchanger composing a heat pump, together with a compressor, and the heat exchanger may include a dehumidifying part dehumidifying air passing the circulation duct in a refrigerant evaporation process and a heating part heating air passing the circulation duct in a refrigerant condensation process.

A fan may be provided at a front end or rear end of the circulation duct.

The fan may be provided in a ventilation duct guiding air having passed the circulation duct to the accomodating space, connected with a rear end of the circulation duct.

In another aspect, a laundry treating machine includes an accomodating space receiving laundry therein; a circulation duct circulating air inside the accomodating space and dehumidifying or heating the circulated air; a steam generator supplying steam to the accomodating space; a water supply tank supplying moisture to the steam generator, the water supply tank being detachable; a water collecting tank collecting water condensed from the steam supplied by the steam generator or water remaining in the steam generator; and a drain tank to which the collected water of the water collecting tank is drained, the drain tank being detachable.

A steam spraying unit supplying the steam generated in the steam generator to the accomodating space may be provided in the accomodating space and the water condensed from the steam supplied to the accomodating space, the steam spraying unit and the circulation duct may be collected in the water collecting tank.

The accomodating space and the steam spraying unit may be connected with the circulation duct and the circulation duct is connected with the water collecting tank such that the water condensed from the steam supplied to the accomodating space and the steam spraying unit may be collected in the water collecting tank, passing the circulation duct.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF THE EMBODIMENTS

Reference will now be made in detail to the embodiments of the present invention, examples of which are illustrated in the accompanying drawings. Wherever possible, the same reference numbers will be used throughout the drawings to refer to the same or like parts.

A laundry treating machine according to the present invention may include a moisture supply device supplying moisture to the accomodating space 12 receiving the laundry. The moisture supply device supplying moisture to the laundry received in the accomodating space 12 may be a moisture supply device supplying moisture, for example, sprayed water or steam generated by heating water. That is, the moisture supplying device may be any types only capable of supplying moisture to the laundry received in the accomodating space 12 uniformly.

For now on, a steam generator will be exemplified as the moisture supplying device and the steam generator generates steam that will be supplied to the accomodating space. Nothing is meant to restrict the scope of the invention to use with steam generators.

A laundry treating machine drying laundry after supplying steam to treat the laundry and a steam dryer tumbling laundry by using a drum provided therein will be explained by focusing on a case that uses a detachable drain tank.

A case including a water drainage part for a user to drain condensed water to a drain directly may be included a scope of the present invention. The amount of water used to supply moisture to the accomodating space 12 is not so much and an embodiment presenting a detachable water tank type water supply source like the water drain tank will be explained. In addition, a case using water supply facilities as a water supply source will be included the scope of the present invention.

In reference to corresponding drawings, an embodiment of a laundry treating machine including a steam generator is used as a moisture supply device and including a detachable water tank as a water supply part and a water drain tank as a water drain part will be described in detail.

Figure 1:
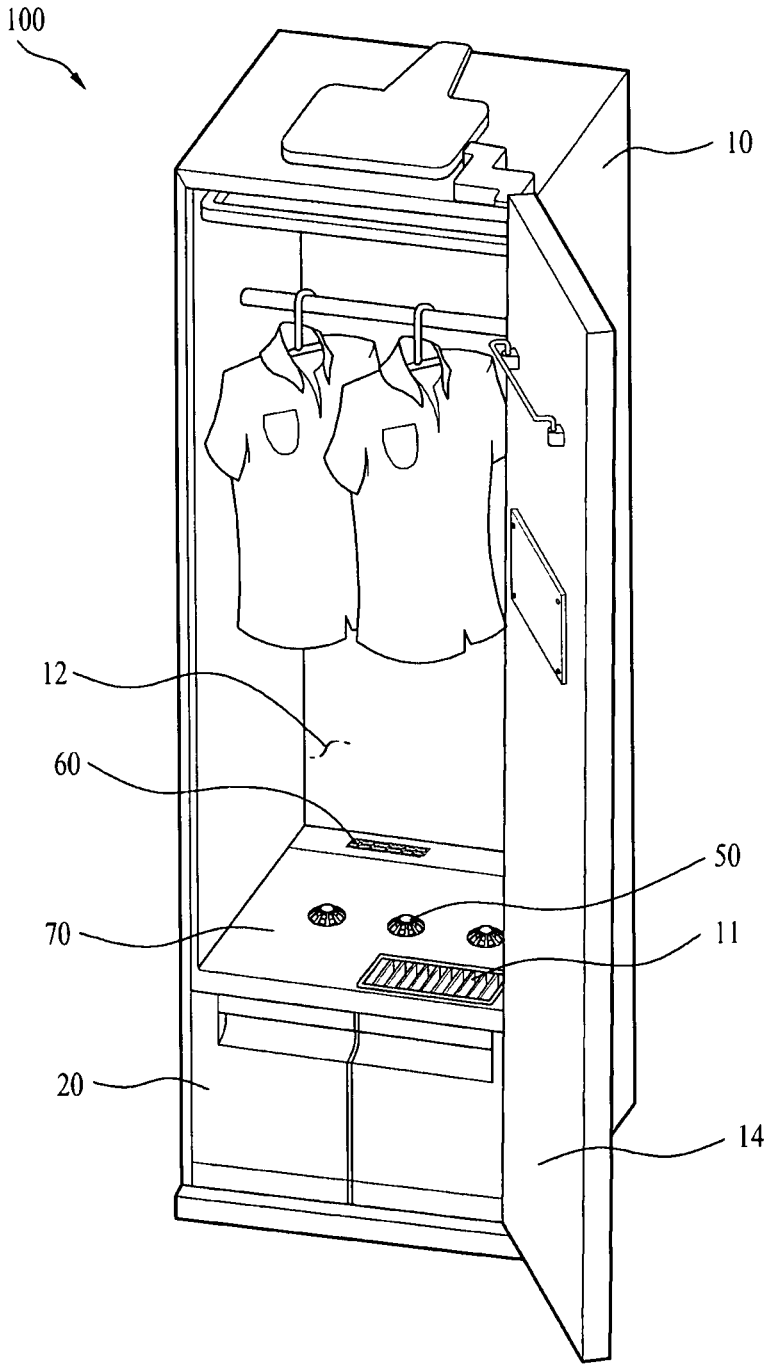
FIG. 1 is a perspective view illustrating a laundry treating machine according to an exemplary embodiment of the invention.
Figure 2:
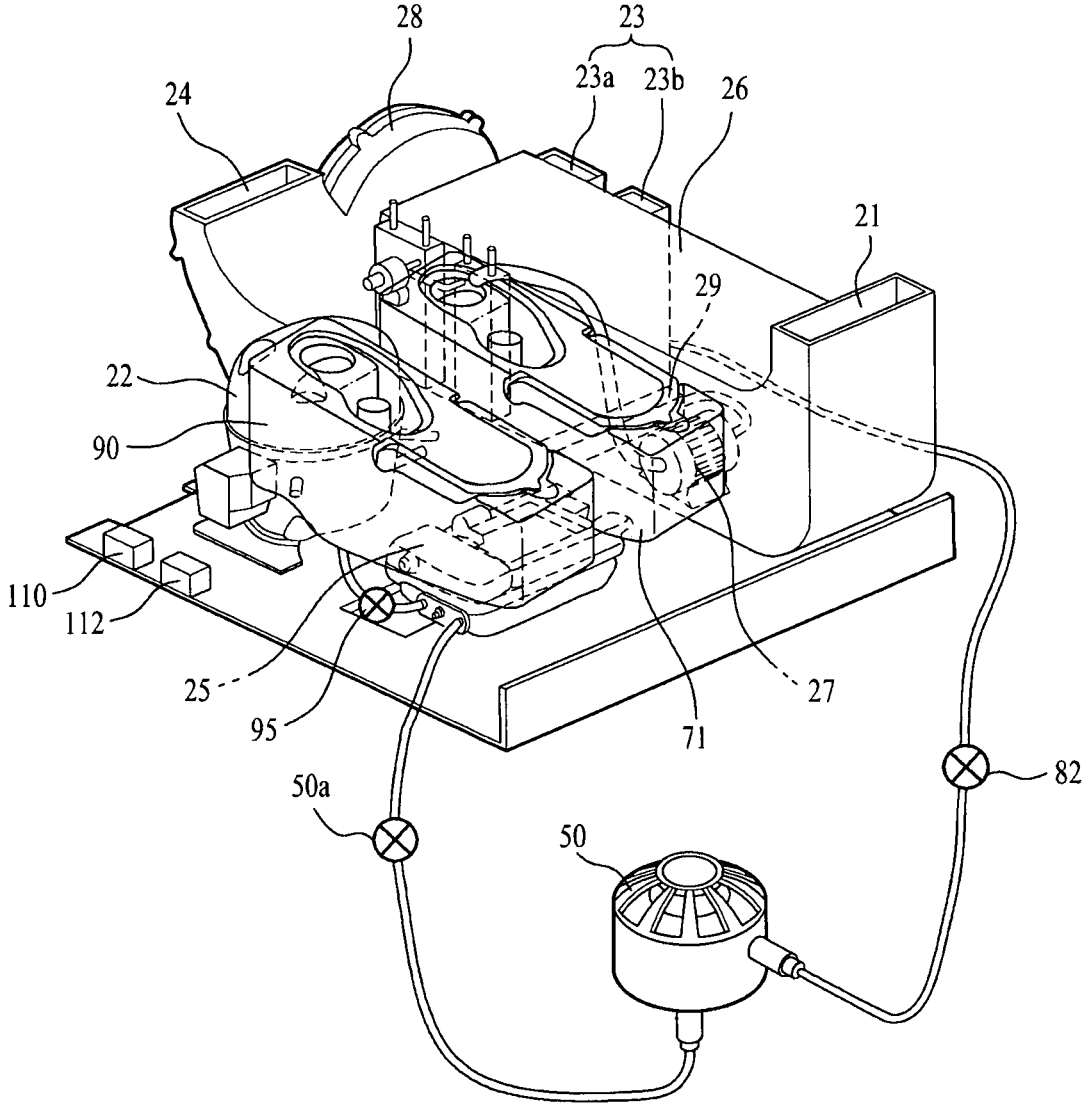
FIG. 2 is a perspective view of the components housed in a mechanism compartment provided in the laundry treating machine of FIG. 1.

FIG. 1 is a perspective view of a laundry treating machine 100 according to an embodiment of the invention, and FIG. 2 is a perspective view of the components housed in a mechanism compartment 20 of the laundry treating machine 100 of FIG. 1.

As shown in FIG. 1, the laundry treating machine 100 according to an embodiment of the invention includes an accomodating space 12 in which clothes are received, and a mechanism compartment 20 that is disposed at a lower portion of the accomodating space 12. The mechanism compartment 20 is provided with various components, which provide moisture, circulate air, heat air, and dehumidify air in the accomodating space 12. These processes are carried out to accomplish the goal of de-wrinkling clothes, and removing odors or moisture from the clothes placed in the accomodating space 12.

The accomodating space 12 and mechanism compartment 20 may be provided in one cabinet 10, and the accomodating space 12 is accessed by a door 14, which may selectively be opened or closed.

At least some of the components housed in the mechanism compartment 20 may draw-in air from the accomodating space 12 and re-supply it back to the accomodating space 12. In a bottom surface 70 of the accomodating space 12, an inlet 11 through which air in the accomodating space 12 is introduced and an outlet 60 through which air to be re-supplied is discharged, are provided.

Inlet 11 and outlet 60 are provided in the bottom surface 70 of the accomodating space 12. The mechanism compartment 20 is disposed below the accomodating space 12.

Also, a steam spraying unit 50, by which steam generated from the steam generator 25 is provided in the mechanism compartment 20 and adapted to spray steam into the accomodating space 12.

A net-shaped structure may be installed at the inlet 11 and outlet 60 in order to prevent foreign materials above a certain size from introducing from the outside.

FIG. 2 is a perspective view of the components housed in a mechanism compartment 20 provided in the laundry treating machine 100 of FIG. 1 according to an embodiment of the invention.

The mechanism compartment 20 of the laundry treating machine includes a steam generator 25 as a moisture supply device. The steam generator 25 generates steam to be supplied to the accomodating space 12 in which clothes are received. A hot air supply device 22, which draws-in humid air from the accomodating space 12 and dehumidifies or heats it in order to dry or heat the received clothes.

The hot air supply device 22 may use a heat pump and or an electric heater. Here, even in case of using the heat pump, an electric heater could be used additionally to heat the circulated air sufficiently. The heat pump used in the laundry treating machine according to the present invention includes a compressor and a heat exchanger. The compressor compresses refrigerant. The heat exchanger dehumidifies circulated air through refrigerant evaporating and condensing processes and then heats the dehumidified air.

Air circulated along a circulation duct 26 by the hot air supply device may be dehumidified or heated by heat-exchanging with refrigerant at a heat exchanger 23 provided therein.

Of course, the circulation duct 26 has a blowing function that circulates unheated air by simply blowing the air. This blowing function is performed by a ventilation duct 28 having a fan so that air having passed the circulation duct 26 is discharged through the outlet 60.

The hot air supply device, including the circulation duct 26 is classified into a heat pump using type and an electric heater using type, based on how to heat dehumidified air.

In either case, a heat pump or an electric heater is used as a means for heating air to be re-supplied to the accomodating space 12. A dehumidification process is performed by condensing humid air introduced through the inlet 11 formed at the bottom of the accomodating space 12.

As shown in FIG. 2, in case the heat pump including a compressor 22 and a heat exchanger is provided to heat the dehumidified air, a heat exchanger 23 may be provided which includes a condensing part 23*b* that dehumidifies humid air by evaporating refrigerant compressed from a compressor 22 and a heating part 23*a* that heats the dehumidified air by condensing the refrigerant are provided in the circulation duct 26.

Even when the heat pump is used to dehumidify and heat humid air, a separate electric heater (not shown) may also be further provided to sufficiently heat the dehumidified air as mentioned above.

Also, the laundry treating apparatus having a drying function may be classified into a circulating-type laundry treating machine and an exhausting-type laundry treating machine, based on how each machine dries clothes.

That is, the laundry treating machine may be classified into an exhausting-type and a circulating-type according to whether humid air is discharged to the outside after being drawn-in to the heat exchanger or whether the air is re-supplied to the accomodating space 12. However, the laundry treating device 100 according to the present invention is the circulating-type that circulates and dehumidifies air in the accomodating space 12. The circulating-type laundry treating machine will be explained below.

Therefore, the air introduced into the circulation duct 26 is dehumidified by the condensing part 23*b* and it is heated by the heating part 23*a*, and it is re-supplied to the accomodating space 12 via the ventilation duct 28.

An outlet hole 24 which is fluidly communicated with the outlet 60 of the accomodating space 12 is formed at the ventilation duct 28, and an inlet hole 21 which is fluidly communicated with the inlet 11 of the accomodating space 12 is formed at the other end of the circulation duct 26.

The heat exchanger 23 according to the present invention dehumidifies humid air circulated through the accomodating space 12 by using refrigerant supplied from the compressor 22 during an evaporation process of the refrigerant, and reheats the air dehumidified through a condensation process of the refrigerant.

The compression of the refrigerant is required between the evaporation and condensation processes. The compression of the refrigerant is carried out at the compressor 22 provided in the mechanism compartment 20.

In the mechanism compartment 20 shown in FIG. 2, a drain tank 71 which is detachable from the mechanism compartment 20 is provided as a water drain part. Water condensed at the heat exchanger 23 is temporarily collected in a water collecting tank 29 disposed below the heat exchanger 23, drainage water collected in the water collecting tank 29 is flowed to the drain tank 71 and is stored therein.

The water collecting tank 29 also has a function of temporarily storing remaining water or condensate water from the accomodating space 12 in order to discharge remained water in the steam generator 25 or condensate water of the accomodating space to the drain tank 71, as well as the water collecting tank 29 collects condensate water of the heat exchanger in the circulation duct 26.

The drain tank 71 can be an outside sewerage pipe instead of being a detachable tank. However, the drain tank 71 configured as a detachable water tank will be explained because, otherwise, the laundry treating machine 100 would need to be installed at a location where a sewer system was available.

A user of the laundry treating machine 100 selectively separates the drain tank 71 from the mechanism compartment 20 by considering the capacity of the drain tank 71, and therefore he can discharge drainage water stored therein. The movement of drainage water from the water collecting tank 29 to the drain tank 71 may be performed by a drain pump 27 and the like. The drain pump 27 can be embedded in the water collecting tank 29.

Also, the water collecting tank 29 may include a water-level sensor (not shown) which is able to measure the level of water by sensing whether electric current is flowed through electrodes in the water collecting tank 29. The reason why this water-level sensor is provided is to determine a point of time that drains water in the water collecting tank 29 off. That is, since condensate water condensed at the heat exchanger 23 and so on is not drained into the drain tank 71 but is stored in the water collecting tank 29, water in the water collecting tank 29 is required to be drained into the drain tank 71 when the water collecting tank is full of water, and therefore the water-level sensor may be provided to determine the level of water in the water collecting tank.

The reason why the separate water collecting tank is provided will be explained. If the drain tank 71 can be disposed below the heat exchanger 23, the water collecting tank 29 can be abbreviated, however the drain tank may be provided at an upper portion of the mechanism compartment by using the pump in order to allow the drain tank 71 to be detachably coupled to the mechanism compartment 20.

That is, it is necessary to make up for height difference by means of the drain pump 27, since the drain tank 71 is preferably disposed above the mechanism compartment 20 so that the user can easily detach and attach the drain tank 71 from and to the laundry treating machine 100.

In one embodiment, the drain tank 71 and a water supply tank 90 may be detachably installed. It is preferable that they are configured to be drawn from or pivoted around the mechanism compartment in a state where they are installed in a drawer (not shown). In one embodiment, the tanks are in a drawer that is movably or rotatably provided at the mechanism compartment 20.

Rather than to allow the drain tank 71 to be detachable smoothly, the other reason why the water collecting tank is provided will be explained. As mentioned above, the water collecting tank 29 may include the water level sensor and the water collected in the water collecting tank may be pumped by the pump and the like. However, the portion where the steam supplied by the steam generator 25 is condensed is not limited to the heat exchanger 23 of the circulation duct 26 and it may be an inside of the accomodating space 12 or an inside of the steam spraying unit 50.

To drain the water condensed in the accomodating space 12 and the steam spraying unit 50 into the drain tank 29, the condensed water should be collected at each predetermined portion of them and a drain pump capable of pumping the collected water should be provided. If a pipe connecting the two elements and the drain pump should be provided, the inner structure of the mechanism compartment 20 would be complex and the production cost would be increased accordingly. Because of that, the water condensed at both the accomodating space 12 and the steam spraying unit 50 may collected at the water collecting tank 29 and it may be conveniently drained by using a single drain pump.

This is possible because, in the exemplary embodiment, the water collecting tank 29 is provided in the lower portion of the mechanism compartment 20, to make natural drainage possible without the auxiliary drain pump 27. At this time, the length of the connection pipe should be increased to connect the water collecting tank 29 with both of the accomodating space 12 and the steam spraying unit 50. Because of that, the contaminated or condensed water may be collected in the water collecting tank 29 via the air circulation duct 26 positioned nearest to the insides of the accomodating space 12 and the steam spraying unit 50. The air circulation duct 26 includes the heat exchanger 23 and the condensed water may be collected in the dehumidifying part 23*b* of the heat exchanger 23. As a result, if the water collecting tank 29 is connected with a lower portion of the air circulation duct 26 and both of the accomodating space 12 and the steam spraying unit 50 are connected with the circulation duct 29, the water condensed from the supplied steam will be collected in the water collecting tank 29 directly or via the air circulation duct 26. Accordingly, the length of the connection pipe may be minimized and the inner structure of the mechanism compartment 20 may be simplified, with reduced production cost.

Since the contaminated drainage water is transferred from the water collecting tank 29 to the drain tank 71 by using the drain pump and the like, the size of the water collecting tank 29 can be smaller than the drain tank 71.

The steam to be supplied to the clothes received in the accomodating space 12 is generated as the steam generator 25 provided in the mechanism compartment 20 heats water supplied from the water supply tank 90 provided in the mechanism compartment 20, and is supplied to the accomodating space 12.

The water supply tank 90 can be configured as a water tank which is detachable from the mechanism compartment, the same as the drain tank 71 in FIG. 2.

Because the amount of water necessary to produce steam is not voluminous and installation is required where no waterworks is available, a detachable water supply tank 90 is preferably used. Of course, in case the waterworks is located adjacent to the laundry treating machine 100, the water supply tank 90 may also be directly connected to the waterworks.

The water supply tank 90 supplies water to the steam generator 25 and the steam generator 25 sprays steam into the received clothes via the steam spraying unit 50.

In the embodiment shown in FIG. 2, the steam spraying unit 50 through which steam generated from the steam generator 25 is sprayed is described as a single steam spraying unit 50. Although a plurality of steam injection units 50 are installed at the bottom surface 70 of the accomodating space 12 in accordance with the embodiment of the invention as illustrated in FIG. 1. However, one steam injection unit 50 will be explained for the sake of convenience, as shown in FIG. 2.

The drawing-in or the discharge of air in the accomodating space through the circulation duct 26 is carried out by a fan in the ventilation duct 28 located adjacent to the circulation duct 26.

The air in the accomodating space, which is drawn-in through the inlet hole 21 fluidly communicated with the inlet 11 in the accomodating space 12, is transferred to the outlet hole 24 via the heat exchanger 23 and it is discharged to the accomodating space 12 through the outlet hole of the accomodating space 12.

The steam generator 25 according to the present embodiment generates steam as a specific amount of water accommodated in a water tank of a specific size is heated by an embedded heater. However, according to the present invention, any device capable of producing steam can be used as the steam generator. For example, it is also possible to heat water by directly installing a heater to the periphery of a water supply hose through which water passes, i.e. without storing water in a specific space.

If the remaining water is discharged to the drain tank 71, it will be drained via the water collecting tank 29 as mentioned above.

The steam generator 25 sprays steam into the accomodating space, in which clothes are received, via the steam spraying unit 50.

The steam spraying unit 50 is connected with the steam generator 25, and it can be configured that condensate water thereof is discharged to the drain tank 71.

In order to directly drain the condensate water from steam into the drain tank 71, the condensate water from steam may be directly connected to the water collecting tank 29 or be connected with the circulation duct 26 connected with the water collecting tank 29.

In the latter case, it is possible to drain the condensate water from steam together with condensate water condensed at the condensing part 23*b* into the drain tank 71 via the water collecting tank 29. A method of simplifying the structure is used by considering the length of pipes that connect each of parts.

Even though the condensate water condensed in the steam spraying unit 50 can be discharged to the drain tank 71 right after the condensate water is generated, it is preferable to allow the condensate water to be evaporated by leaving it in the steam spraying unit 50 for a predetermined time rather than to discharge it right away. This preference is because the condensate water from steam is at a very high temperature state. The reason why the water condensed from steam is left for the predetermined time period is so as to avoid changing the temperature of the supplied steam or to make the supplied steam to be re-gasified (i.e., evaporated).

Also, if the condensate water stays, the supplied steam can be easily injected because the space in the steam injection unit 50 is diminished. Therefore, the condensate water from steam, which is collected in the steam spraying unit 50, can remain in the steam spraying unit 50 for a predetermined time.

In order to let the condensate water in the steam spraying unit 50 remain in that unit, a cutoff valve 82 may be provided between the condensate water outlet and the drain tank 71.

This is because the produced condensate water is prevented from being discharged through the condensate water outlet 53 by the cutoff valve 82, right after the condensate water is produced. Also, the cutoff valve 82 is preferably a magnetic valve which is controlled by the controller 110 (FIG. 2) of the laundry treating machine 100.

Further, the condensate water condensed at the steam spraying unit 50 is not directly discharged to the drain tank 71 but is discharged thereto via the water collecting tank 29. In case the condensate water is discharged to the pump 27 after being temporarily stored in the water collecting tank 29, the condensate water can be discharged together with condensate water from the heat exchanger 23, and therefore it is convenient.

Also, the condensate water collected in the steam injection unit 50 can be directly drained to the water collecting tank 29, however it can be also drained to the water collecting tank via the air circulation duct 26. The latter is applicable when the length of pipes defining a discharge path of the condensate water is shortened or the structure is simplified by stopping over the circulation duct 26.

The movement of condensate water from the water collecting tank 29 to the drain tank 71 is carried out by the drain pump 27 connecting both sides. The difference in height is compensated by the drain pump 27, since the drain tank 71 is located higher than the water collecting tank 29.

The drain tank 71 according to the present embodiment is provided as a detachable water tank, however water can be directly discharged from the water collecting tank in a state where sewerage system is available.

Therefore, it is preferable that a pipe, which is provided to discharge condensate water from the water collecting tank 29, is selectively connected to the detachable drain tank 71 or sewerage system (not shown).

Figure 3:
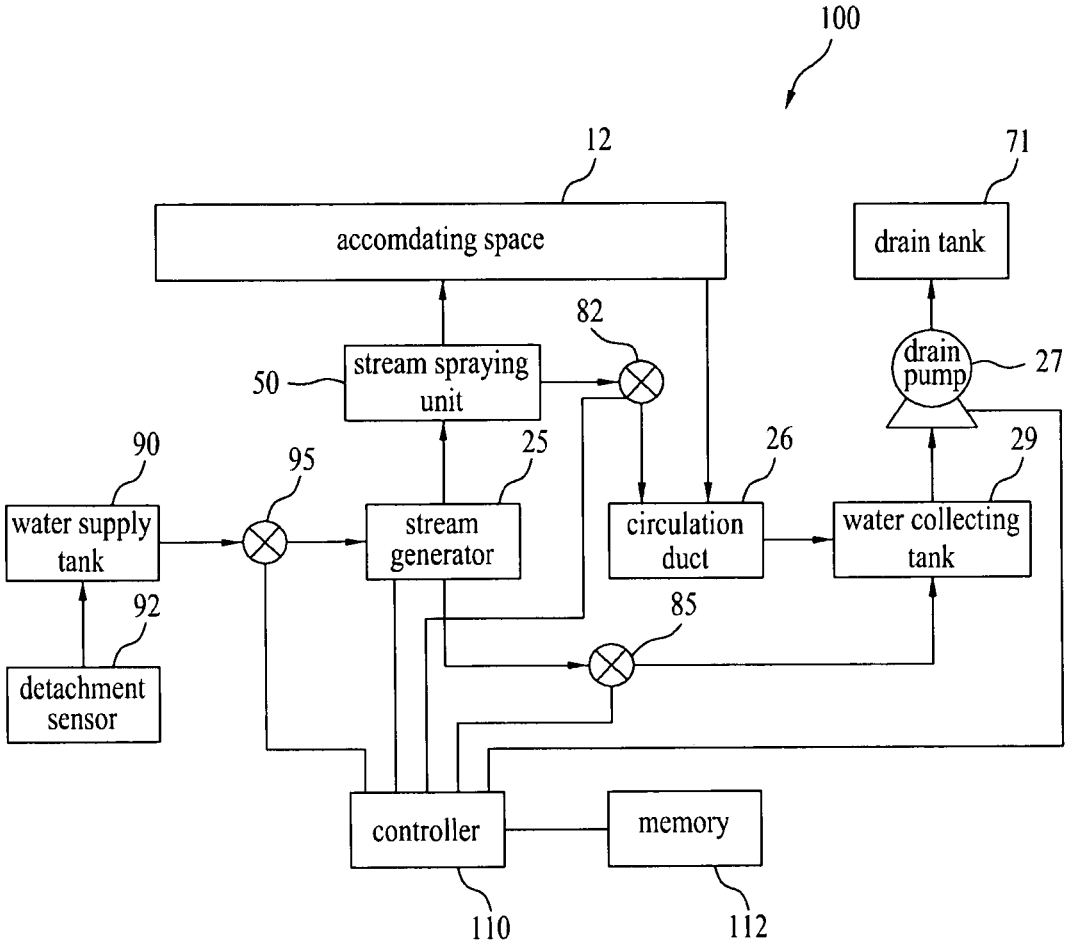
FIG. 3 is a schematic illustration of physical paths that permit a flow of steam and water to various parts of the laundry treating machine according to an embodiment of the invention.

FIG. 3 is a schematic illustration of physical paths that permit a flow of steam and water to various parts of the laundry treating machine 100 according to an embodiment of the invention.

When the detachable water supply tank is used, the time period for which the water inside the water supply tank can be kept may be substantially long, but after the long period of time expires, bacteria would breed. Water containing bacteria may not be supplied to the laundry and the water inside the water supply tank 90 should be drained. The water of the water supply tank 90 may be drained by the user directly after being separated from the laundry treatment devise. Alternatively, the water inside the water supply tank 90 may be drained to the drain tank 90 via a drain passage of the laundry treating machine 100.

As shown in FIG. 3, the water supply tank 90 is coupled to the steam generator 25 to supply water thereto. Also, the steam generator 25 is connected with the water collecting tank 29 to drain its remaining water. As a result, the water of the water supply tank 90 may be drained to the water collecting tank 29, using such the path.

According to the embodiment shown in FIGS. 2 and 3, the steam generator 25 is coupled to the water collecting tank 29. Here, the steam generator 25 also may be connected with water supply tank 90, bypassing the circulation duct 26. In other words, as shown in FIG. 3, the process of draining water inside the detachable water supply tank 90 into the detachable drain tank 71 is routed through the steam generator 25. Thus, as the steam generator 25 is coupled to both the water collecting tank 29 and the drain tank 71, water in the water supply tank 90 can be discharged through the draining path provided for draining water from the water collection and drain tanks 29 and 71, respectively.

The laundry treating machine according to the exemplary embodiment of FIGS. 2 and 3 is thus configured such that any water remaining in the steam generator 25 can be drained into the water collecting tank 29. Of course, it is also possible to drain it into the water collecting tank 29 via the condensate water accommodating space of the air circulation duct 26, as described above.

As illustrated in FIGS. 2 and 3, a first valve 95 is provided between the steam generator 25 and the water supply tank 90. As the first valve 95 is opened, water in the water supply tank 90 can be supplied into the steam generator. Therefore, in the embodiment of FIGS. 2 and 3, a water supply tank draining step of a method of controlling the laundry treating machine 100 would require the opening of the first valve 95.

The first valve provided between the steam generator 25 and the water supply tank 90 can be applicable when the natural supply of water from the water supply tank 90 to the steam generator is available, however a separate water supply pump (not shown) can be provided when the height of the steam generator 25 is equal to or higher than that of the water supply tank 90.

If such a water supply pump is provided, the physical location of the steam generator 25 and the water supply tank 90 in the mechanism compartment 20, or in any portion of the laundry treating machine 100, can be unrestrictedly determined.

Also, a drain valve 85 (FIG. 3) may be provided between the steam generator 25 and the water collecting tank 29. The drainage from the steam generator 25 to the water collecting tank 29 may be performed by opening the drain valve 85. Therefore, when a drain signal is received by the controller 110, the controller 110 can execute commands stored in a memory 112, which cause the laundry treating machine 100 to drain water from the water supply tank 90 into the water collecting tank 29 by opening the water supply valve 95 and drain valve 85.

Referring to FIG. 2, the height of each component of the laundry treating machine 100 may be selected such that the water collecting tank 29 is provided at a bottom of the mechanism compartment 20 and thus the drainage from the water supply tank 90 into the water collecting tank 29 can be performed by opening the valves without the need of a separate pump. However, if a difference in hydraulic pressure, which would enable water to be drained from the water supply tank 90 to the water collecting tank 29 via the steam generator 25, does not exist in sequential processes of draining, a pump and the like would be needed to perform a draining operation.

In one embodiment, a method of draining water collected in the water collecting tank 29 into the drain tank 71 may be performed by drain pump 27, which may be provided between the water collecting tank 29 and the drain tank 71.

The drain pump 27 may compensate for a height difference between the water collecting tank 29 and the drain tank 71. Therefore, depending on the position of the components in the laundry treating machine 100, if natural drainage is available, the drainage may be controlled simply by operating certain control valve(s) 95, 85. However, if natural drainage is not available, drain pump 27 would be needed.

As described above, the draining processes from the water supply tank 90, the steam generator 25 and the water collecting tank 29 to the drain tank 71 have been discussed. These draining processes are performed by opening the corresponding control valves and by operating the drain pump.

According to the laundry treating machine 100 of the present invention, moisture is supplied to the received laundry and hot air is supplied to the laundry having received the moisture, such that the laundry is dried. Through such the method, unpleasant odor, wrinkles, or humidity remaining the laundry may be removed to provide the user with the satisfaction of pleasant feeling.

In such the method, the laundry treating machine 100 according to the present invention can appropriately supply water required to generate the moisture, which will be supplied to the received laundry, and discharge the water condensed or remaining after the processes of the moisture supply and the system may be drained efficiently.

In addition, the laundry treating machine 100 according to the present invention can minimize the number of parts required to discharge the condensate water generated therein and can simplify the drainage path.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating machine comprising:

a cabinet including an accommodating space configured to receive laundry therein and a mechanism compartment that is partitioned from the accommodating space;

a moisture supply device provided in the mechanism compartment and configured to supply moisture to the accommodating space;

a water supply tank provided in the mechanism compartment and detachably coupled only to the moisture supply device for supplying water to the moisture supply device;

a water discharge part provided in the mechanism compartment and configured to store water condensed from the moisture supplied by the moisture supply device or water remaining in the moisture supply device subsequent to a moisture supply operation;

a circulation duct configured to draw-in air from the accommodating space and discharge the air back into the accommodating space; and a heat exchanging part provided in the circulation duct, wherein air circulating through the heat exchanging part is dehumidified or heated, wherein the water supply tank is detachable from the mechanism compartment and the moisture supply device for filling water to the water supply tank and discharging water remaining in the water supply tank.

2. The laundry treating machine according to claim 1, wherein the moisture supply device is a water spraying device or a steam generator.

3. The laundry treating machine according to claim 1, wherein the water discharge part is a detachable water tank.

4. The laundry treating machine according to claim 3, wherein the circulation duct and the moisture supply device are provided in the mechanism compartment, and wherein an inlet drawing in air from the accommodating space into the circulation duct and an outlet discharging air inside the circulation duct to the accommodating space are formed at a bottom of the accommodating space which partitions off inner space of the cabinet into the accommodating space and the mechanism compartment.

5. The laundry treating machine according to claim 3, wherein the water discharging part comprises:

a water collecting tank collecting water condensed from the moisture supplied by the moisture supply device and water remaining in the moisture supply device subsequent to a moisture supply operation; and a drain tank detachably connected to the water collecting tank for storing water discharged from the water collecting part.

6. The laundry treating machine according to claim 5, wherein the circulation duct is fluidly coupled to the water collecting tank and water condensed inside the circulation duct is collected in the water collecting tank.

7. The laundry treating machine according to claim 6, wherein the moisture supply device is a steam generator and a steam spraying unit is provided in the accommodating space to supply steam generated by the steam generator to the accommodating space, and water condensed inside the steam spraying unit and water remaining in the steam generator is collected in the water collecting tank.

8. The laundry treating machine according to claim 7, wherein the water condensed in the steam spraying unit is collected in the water collecting tank, through the air circulation duct coupled to the steam spraying unit.

9. The laundry treating machine according to claim 8, wherein a cutoff valve selectively cuts off flow of condensed water and the cutoff valve is provided at a pipe connecting the steam spraying unit with the air circulation duct.

10. The laundry treating machine according to claim 5, wherein the water condensed in the accommodating space is collected in the water collecting tank, passing the circulation duct.

11. The laundry treating machine according to claim 5, further comprising:

a drain pump pumping the water collected in the water collecting tank to the drain tank.

12. The laundry treating machine according to claim 5, wherein the water collecting tank comprises a water level sensor adapted to measure a water level of the collected water.

13. The laundry treating machine according to claim 5, wherein if the moisture supply device is a steam generator, a valve selectively cutting off the flow of water is provided in at least one of a pipe connecting the water supply tank and the steam generator and a pipe connecting the steam generator and the water collecting tank.

14. The laundry treating machine according to claim 7, wherein the steam spraying unit is provided at a bottom of the accommodating space in plural.

15. The laundry treating machine according to claim 1, wherein the heat exchanging part is a heat exchanger comprised of:

a heat pump, a compressor, and a heat exchanger, comprised of:

a dehumidifying part adapted to dehumidify air passing through the circulation duct in a refrigerant evaporation process; and a heating part adapted to heat air passing through the circulation duct in a refrigerant condensation process.

16. The laundry treating machine according to claim 15, wherein a fan is provided at a front end or rear end of the circulation duct.

17. The laundry treating machine according to claim 16, wherein the fan is provided in a ventilation duct guiding air having passed the circulation duct to the accommodating space, connected with a rear end of the circulation duct.

18. A laundry treating machine comprising:

an accommodating space receiving laundry therein;

a circulation duct circulating air inside the accommodating space and dehumidifying or heating the circulated air;

a steam generator supplying steam to the accommodating space;

a water supply tank supplying moisture to the steam generator, the water supply tank is detachably coupled only to the steam generator;

a water collecting tank collecting water condensed from the steam supplied by the steam generator or water remaining in the steam generator; and a drain tank to which the collected water of the water collecting tank is drained, the drain tank is detachably coupled to the water collecting tank, wherein the water supply tank is detachable from the steam generator for refilling water to the water supply tank and discharging water remaining in the water supply tank.

19. The laundry treating machine according to claim 18, wherein a steam spraying unit supplying the steam generated in the steam generator to the accommodating space is provided in the accommodating space and the water condensed from the steam supplied to the accommodating space, the steam spraying unit and the circulation duct being adapted to collect water for the water collecting tank.

20. The laundry treating machine according to claim 19, wherein the accommodating space and the steam spraying unit are operationally coupled via the circulation duct and the circulation duct is operationally coupled to the water collecting tank such that water condensed from the steam supplied to the accommodating space and the steam spraying unit is collected in the water collecting tank, after passing through the circulation duct.

21. The laundry treating machine according to claim 18, wherein the water supply tank and the drain tank are configured to be pivoted around the mechanism compartment or to be drawn out from the mechanism compartment.

* * * * *